US009763293B2

(12) United States Patent
Malyna et al.

(10) Patent No.: US 9,763,293 B2
(45) Date of Patent: Sep. 12, 2017

(54) APPARATUS FOR DRIVING LOAD VIA CONVERTER

(71) Applicant: PHILIPS LIGHTING HOLDING B.V., Eindhoven (NL)

(72) Inventors: Dmytro Viktorovych Malyna, Eindhoven (NL); Marcel Beij, Sint Oedenrode (NL); Lucas Louis Marie Vogels, Herten (NL); Paul Theodorus Jacobus Boonen, Tegelen (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/906,580

(22) PCT Filed: Jul. 16, 2014

(86) PCT No.: PCT/EP2014/065186
§ 371 (c)(1),
(2) Date: Jan. 21, 2016

(87) PCT Pub. No.: WO2015/014611
PCT Pub. Date: Feb. 5, 2015

(65) Prior Publication Data

US 2016/0212806 A1 Jul. 21, 2016

(30) Foreign Application Priority Data

Jul. 30, 2013 (EP) ..... 13178528

(51) Int. Cl.
*H05B 33/08* (2006.01)

(52) U.S. Cl.
CPC ..... *H05B 33/0815* (2013.01); *H05B 33/0845* (2013.01)

(58) Field of Classification Search
CPC .... H05B 37/02; H05B 37/0227; H05B 33/08; H05B 33/0809; H05B 33/0815; H05B 33/0848
USPC ..... 315/200 R, 219, 224–226, 291, 307, 308
See application file for complete search history.

(56) References Cited

U.S. PATENT DOCUMENTS

| | | | |
|---|---|---|---|
| 8,258,706 B2 | 9/2012 | Maruyama et al. | |
| 8,816,598 B2 | 8/2014 | Dilger | |
| 2010/0090604 A1 | 4/2010 | Maruyama et al. | |
| 2011/0199017 A1 | 8/2011 | Dilger | |
| 2012/0043913 A1 | 2/2012 | Melanson | |
| 2013/0021828 A1 | 1/2013 | Gaknoki et al. | |
| 2015/0022108 A1* | 1/2015 | Malyna | H05B 33/0815 315/200 R |

FOREIGN PATENT DOCUMENTS

WO 2013003810 A1 1/2013

* cited by examiner

*Primary Examiner* — Jimmy Vu
(74) *Attorney, Agent, or Firm* — Akarsh P. Belagodu

(57) ABSTRACT

Apparatuses for driving loads via converters comprise first circuits for interfacing phase-cut dimmers and the converters. Firing angles of the phase-cut dimmers correspond with first moments in time during periods of voltage signals presented to the phase-cut dimmers. The converters draw first current signals from second until third moments in time during the periods. Second circuits control the converters to draw second current signals from fourth until fifth moments in time during the periods, to improve an energy efficiency.

15 Claims, 2 Drawing Sheets

APPARATUS FOR DRIVING LOAD VIA CONVERTER

CROSS-REFERENCE TO PRIOR APPLICATIONS

This application is the U.S. National Phase application under 35 U.S.C. §371 of International Application No. PCT/EP2014/065186, filed on Jul. 16, 2014, which claims the benefit of European Patent Application No. 13178528.9, filed on Jul. 30, 2013. These applications are hereby incorporated by reference herein.

FIELD OF THE INVENTION

The invention relates to an apparatus for driving a load via a converter. The invention further relates to first and second devices and to a method.

Examples of such a device are converters and loads and phase-cut dimmers. Examples of such a load are light circuits comprising one or more light emitting diodes of whatever kind and in whatever combination.

BACKGROUND OF THE INVENTION

US 2013/0021828 A1 discloses an on-time extension for non-dissipative bleeding in a power supply.

US 2011/0199017 A1 discloses a circuit for driving luminous means. The circuit interfaces a dimmer and a converter and comprises a rectifier and a capacitor. During a first interval a first current signal is provided to the converter and during a second interval, controlled by a second circuit, a second current signal is provided to the converter.

SUMMARY OF THE INVENTION

It is an object of the invention to provide an improved apparatus. It is a further object of the invention to provide improved devices and an improved method.

According to a first aspect, an apparatus is provided for driving a load via a converter, the apparatus comprising:

a first circuit for interfacing a phase-cut dimmer and the converter, a firing angle of the phase-cut dimmer corresponding with a first moment in time during a period of a voltage signal presented to the phase-cut dimmer, and the converter being arranged to draw a first current signal from a second moment in time until a third moment in time during the period of the voltage signal, the first circuit comprising a rectifier with first and second inputs arranged to be coupled to first and second outputs of the phase-cut dimmer and a filter coupled to the rectifier, the filter comprising one or more output capacitors, and a second circuit for controlling the converter to draw a second current signal from a fourth moment in time until a fifth moment in time during the period of the voltage signal, the fourth and fifth moments in time being situated after the third moment in time, wherein the first circuit further comprises:

a first diode with a first electrode coupled to a first output of the rectifier and with a second electrode coupled to the filter, and a bleeder with a main current path coupled to the first electrode of the first diode and to the second output of the rectifier and with a bias current path coupled to the second electrode of the first diode and to the second output of the rectifier.

A first circuit interfaces a phase-cut dimmer and a converter. The phase-cut dimmer comprises for example a thyristor dimmer or a triac dimmer etc. The converter comprises for example a buck converter or a boost converter or a buck-boost converter or a flyback converter or a switch mode converter etc. A firing angle of the phase-cut dimmer corresponds with a first moment in time during a period of a voltage signal that is presented to and present across inputs of the phase-cut dimmer. At the first moment in time as defined by the firing angle, the phase-cut dimmer goes from a non-conductive state into a conductive state, until the voltage signal crosses zero. The converter is arranged to draw a first current signal from a second moment in time until a third moment in time during the period of the voltage signal. The second moment in time is situated on or after the first moment in time. By having introduced a second circuit for controlling the converter to draw a second current signal from a fourth moment in time until a fifth moment in time during the period of the voltage signal, which fourth and fifth moments in time are situated after the third moment in time, an efficiency of a combination of the apparatus and the converter can be improved when used in combination with the phase-cut dimmer. Such an improved efficiency is a great advantage.

Certain phase-cut dimmers require a bleeder for extending a time-interval during which a current signal flows through the phase-cut dimmer. By having located a main current path of the bleeder before the first diode and by having located a bias current path of the bleeder behind the first diode, the first diode will prevent that the one or more output capacitors can be discharged by the main current path of the bleeder. As a result, most energy stored in the one or more output capacitors becomes available to the converter and can be used between the fourth and fifth moments in time. The amount of energy dissipated by the bias current path of the bleeder is negligible.

Usually, the first to fifth moments in time will each occur twice during a period of the voltage signal presented to the phase-cut dimmer, for a period that is considered to be started with the firing angle or the first moment in time. Usually, this voltage signal will have a sine wave shape comprising a positive half sine wave and a negative half sine wave, and an output signal of the phase-cut dimmer will comprise a part of the positive half sine wave and a part of the negative half sine wave etc.

An embodiment of the apparatus is defined by the first circuit comprising one or more output capacitors, the first current signal being drawn via the first circuit and via the phase-cut dimmer from a supply, and the second current signal being drawn from the one or more output capacitors of the first circuit. By drawing the second current signal from one or more output capacitors of the first circuit, an amount of energy stored in the one or more output capacitors is used to improve said efficiency.

An embodiment of the apparatus is defined by the third moment in time being an adaptable moment in time, and the second circuit being arranged to adapt a next third moment in time in dependence of an amount of energy transferred via the second current signal. In this case, the converter is arranged to reduce an amount of time present between the second and third moments in time and to thereby reduce an amount of energy transferred via the first current signal, which improves said efficiency.

An embodiment of the apparatus is defined by the third moment in time being an adaptable moment in time, and the second circuit comprising an adaptor for adapting a next third moment in time in dependence of an amount of energy transferred via the second current signal. In this case, the second circuit comprises an adaptor arranged to reduce an amount of time present between the second and third moments in time and to thereby reduce an amount of energy transferred via the first current signal, which improves said efficiency.

An embodiment of the apparatus is defined by the first and second and third moments in time being situated before a zero-crossing of the voltage signal, the fourth moment in time being situated on or after the zero-crossing of the voltage signal and the fifth moment in time being situated after the zero-crossing of the voltage signal and before a next first moment in time corresponding with a next firing angle. Before a zero-crossing of the voltage signal, between the second and third moments in time, the converter draws the first current signal from the supply. After the zero-crossing, between the fourth and fifth moments in time, the converter draws the second current signal from the one or more output capacitors of the first circuit. The zero-crossing is a clear borderline: Until the zero-crossing, the supply can deliver the first current signal, and after the zero-crossing, the supply cannot deliver the first current signal, owing to the fact that the phase-cut dimmer is still in a non-conductive state due to a next firing angle not yet having occurred, and the second current signal is to be delivered by the one or more output capacitors.

An embodiment of the apparatus is defined by the second circuit comprising a zero-crossing estimator for estimating the zero-crossing and an activator for in response to an estimation result from the zero-crossing estimator activating the converter. A zero-crossing estimator estimates the zero-crossing and an activator activates the converter in response to an estimation result from the estimator.

A rectifier such as for example a rectifier bridge may for example comprise four diodes without having excluded other rectifiers. A filter may comprise one or more output capacitors, and a first diode may prevent that the one or more output capacitors can be discharged by circuitry present near the rectifier. As a result, all energy stored in the one or more output capacitors becomes available to the converter and can be used between the fourth and fifth moments in time.

An embodiment of the apparatus is defined by the main current path of the bleeder comprising a serial connection of a first resistor and main electrodes of a transistor and a current source for defining a bleeder current signal, and the bias current path comprising a serial connection of a second resistor and a voltage defining element, a common point of the second resistor and the voltage defining element being coupled to a control electrode of the transistor via a second diode, the control electrode of the transistor being coupled to the second output of the rectifier via a biasing capacitor. The transistor may include one transistor or may comprise a combination of two or more transistors. This is a simple and low cost embodiment, whereby it must be noted that each element of the bleeder may be looked at independently from all other elements.

An embodiment of the apparatus is defined by the first circuit not comprising a resistor coupled in parallel to the first diode, or the first circuit comprising a third resistor having a value larger than 100 kΩ coupled in parallel to the first diode. If present, a value of the third resistor may preferably be chosen larger than 500 kΩ, and may more preferably be chosen larger than 1 MΩ.

An embodiment of the apparatus is defined by the filter further comprising an inductor with a first terminal coupled to the second electrode of the first diode and with a second terminal arranged to be coupled to a first input of the converter, the second electrode of the first diode being coupled to the second output of the rectifier via a parallel connection of a first output capacitor and a serial connection of a fourth resistor and a second output capacitor, and the second terminal of the inductor being coupled to the second output of the rectifier via a third output capacitor, the second output of the rectifier being arranged to be coupled to a second input of the converter. The filter has two functions, firstly a storage of energy in the one or more output capacitors and secondly a reduction of electromagnetic interference. This is a simple and low cost embodiment, whereby it must be noted that each element of the filter may be looked at independently from all other elements.

An embodiment of the apparatus is defined by the first circuit further comprising

- a first series damper resistor arranged to be coupled to the first output of the phase-cut dimmer and to the first input of the rectifier, and/or
- a second series damper resistor arranged to be coupled to the second output of the phase-cut dimmer and to the second input of the rectifier, and/or
- a voltage dependent resistor arranged to be coupled to the first and second outputs of the rectifier.

The series damper resistors offer serial damping and the voltage dependent resistor offers protection against transient voltages. Alternative damping solutions and alternative protecting solutions are not to be excluded.

According to a second aspect, a first device is provided comprising the apparatus as defined above and further comprising the converter and/or the load. Further, one or more parts of the apparatus or the entire apparatus may be located inside the converter and/or inside the load. Embodiments of the first device correspond with embodiments of the apparatus.

According to a third aspect, a second device is provided comprising the apparatus as defined above and further comprising the phase-cut dimmer. Further, one or more parts of the apparatus or the entire apparatus may be located inside the phase-cut dimmer. Embodiments of the second device correspond with embodiments of the apparatus.

According to a fourth aspect, a method is provided for driving a load via a phase-cut dimmer and via a converter, a firing angle of the phase-cut dimmer corresponding with a first moment in time during a period of a voltage signal presented to the phase-cut dimmer, and the converter being arranged to draw in a first step via a first circuit a first current signal from a second moment in time until a third moment in time during the period of the voltage signal, the method comprising a second step of controlling by a second circuit the converter to draw via the first circuit a second current signal from a fourth moment in time until a fifth moment in time during the period of the voltage signal, the fourth and fifth moments in time being situated after the third moment in time, and the additional step of extending the time-interval during which a current is withdrawn from the phase-cut dimmer by withdrawing a bleeder current by a bleeder.

An insight is that by providing a first diode and a bleeder, the first diode will prevent that the one or more output capacitors can be discharged by the main current path of the bleeder. As a result, most energy stored in the one or more output capacitors becomes available to the converter and can be used between the fourth and fifth moments in time. The amount of energy dissipated by the bias current path of the bleeder is negligible.

A problem to provide an improved apparatus has been solved. A further advantage is that energy can be used more efficiently, which is of great importance.

These and other aspects of the invention will be apparent from and elucidated with reference to the embodiments described hereinafter.

DETAILED DESCRIPTION OF EMBODIMENTS

Figure 1:
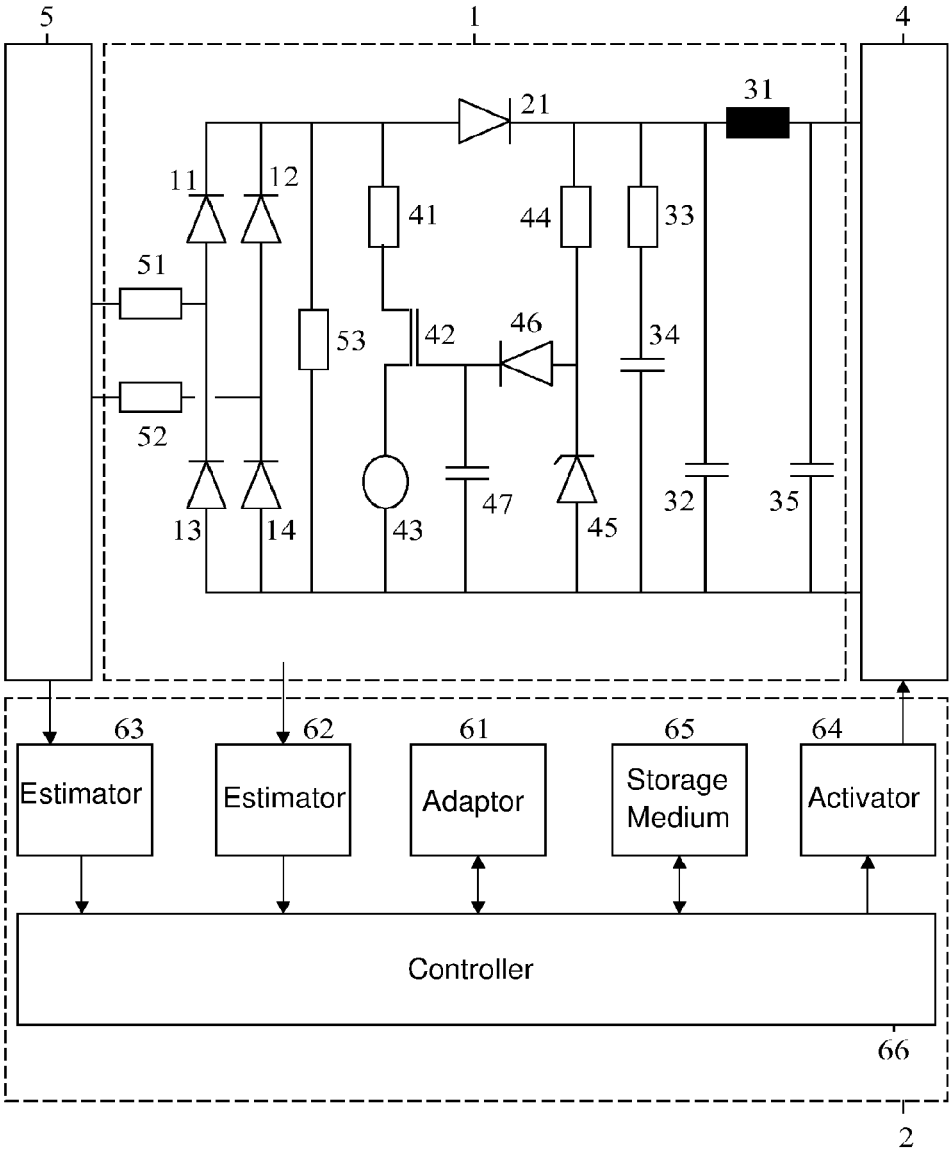
FIG. 1 shows an embodiment of an apparatus.

In the FIG. 1, an embodiment of an apparatus 1, 2 is shown coupled to a phase-cut dimmer 5 and to a converter 4. In a first circuit 1 of the apparatus 1, 2, first and second outputs of the phase-cut dimmer 5 are coupled via first and second series damper resistors 51, 52 to first and second inputs of a rectifier 11-14 here for example comprising four diodes 11-14 in a rectifier bridge. A first output of the rectifier 11-14 is coupled to an anode of a diode 21. A cathode of the diode 21 is coupled to a first terminal of an inductor 31, and a second terminal of the inductor 31 is coupled to a first input of the converter 4.

The first output of the rectifier 11-14 is coupled via a voltage dependent resistor 53 to a second output of the rectifier 11-14. The first output of the rectifier 11-14 is further coupled via a main current path 41-43 of a bleeder 41-47 to the second output of the rectifier 11-14. The main current path 41-43 comprises a serial connection of a resistor 41, main electrodes of a transistor 42 and a current source 43 for defining a bleeder current signal. The cathode of the diode 21 is further coupled via a bias current path 44-47 of the bleeder 41-47 to the second output of the rectifier 11-14. The bias current path 44-47 comprises a serial connection of a resistor 44 and a voltage defining element 45 such as for example a zener diode. A common point of this serial connection is coupled via a diode 46 to a control electrode of the transistor 42. This control electrode is further coupled via a capacitor 47 to the second output of the rectifier 11-14. The cathode of the diode 21 is further coupled via a parallel connection of a capacitor 32 and a serial connection comprising a resistor 33 and a capacitor 34 to the second output of the rectifier 11-14. The second terminal of the inductor 31 is further coupled via a capacitor 35 to the second output of the rectifier 11-14, which is further coupled to a second input of the converter 4. The elements 31-35 form a filter 31-35.

The apparatus 1, 2 further comprises a second circuit 2 comprising an adaptor 61, a zero-crossing estimator 62 with one or more inputs to be coupled to one or more of the inputs or to one or more of the outputs of the rectifier 11-14 and/or a zero-crossing estimator 63 with one or more inputs to be coupled to one or more inputs or to one or more of the outputs of the phase-cut dimmer 5, an activator 64 with one or more outputs to be coupled to one or more control inputs of the converter 4 and a storage medium 65. Each one of the units 61-65 is coupled to a controller 66. Alternatively, the controller 66 may be partially or fully integrated into one or more of the units 61-65, or one or more of the units 61-65 may be partially or fully integrated into the controller 66.

Figure 2:
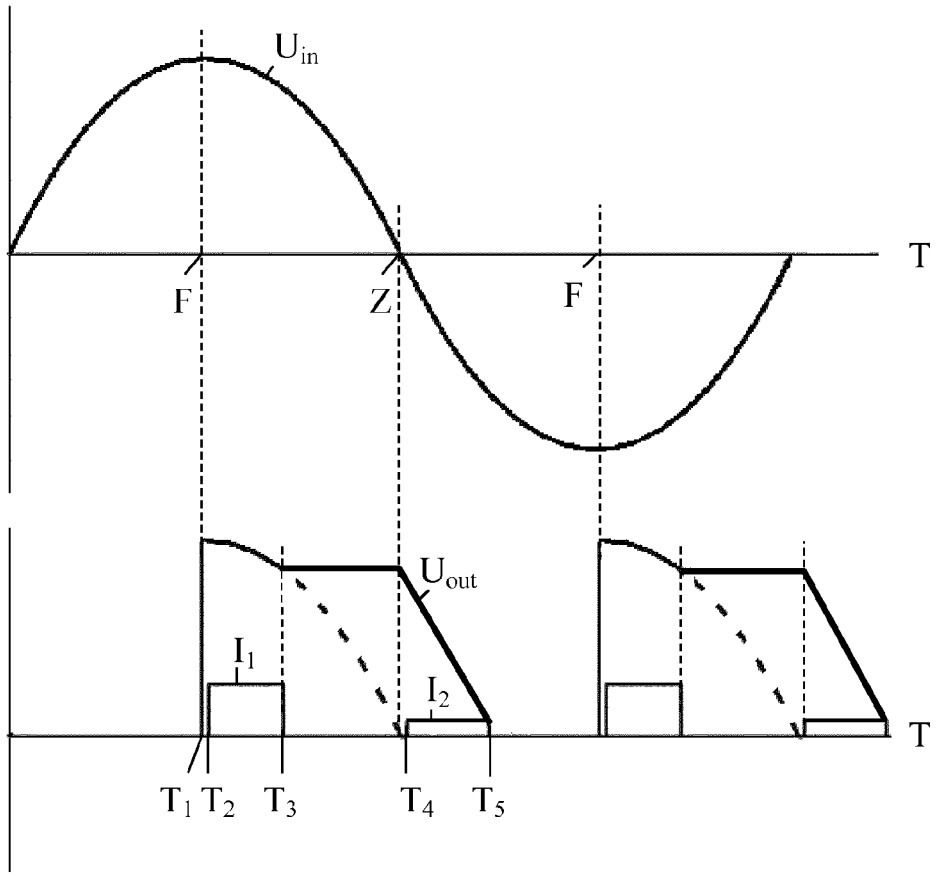
FIG. 2 shows waveforms.

In the FIG. 2, waveforms are shown. In the upper graph, a voltage signal $U_{in}$ is shown versus time T. The voltage signal $U_{in}$ is presented to and present across the inputs of the phase-cut dimmer 5. The phase-cut dimmer 5 is considered to be fired at a firing angle F. The voltage signal $U_{in}$ shows some time after the firing angle F a zero-crossing Z. In the lower graph, a voltage signal $U_{out}$ is shown versus time T. The voltage signal $U_{out}$ is present across the capacitor 32 or 35. Clearly, this voltage signal $U_{out}$ is unequal to zero from the firing angle F to the zero-crossing Z, owing to the fact that the phase-cut dimmer 5 is in a conductive state from the firing angle F to the zero-crossing Z. This voltage signal $U_{out}$ is further unequal to zero during a subsequent time-interval situated after the zero-crossing Z, as discussed below. In the lower graph, further a first current signal $I_1$ and a second current signal $I_2$ are shown.

In the prior art, wherein the firing angle F of the phase-cut dimmer 5 is considered to correspond with a first moment in time $T_1$ during a period of the voltage signal $U_{in}$, the converter 4 will draw the first current signal $I_1$ from a second moment in time $T_2$ until a third moment in time $T_3$ during the period of the voltage signal $U_{in}$ as shown in the lower graph of the FIG. 2. The second moment in time $T_2$ is situated on or after the first moment in time $T_1$. The third moment in time $T_3$ is situated after the second moment in time $T_2$. After the zero-crossing Z, until a next firing angle F, the phase-cut dimmer 5 is in a non-conductive state, and from the zero-crossing Z to the next firing angle F, energy cannot be supplied to the converter 4 via the phase-cut dimmer 5. However, energy might still be present inside the first circuit 1. Unfortunately, this energy still present inside the first circuit 1 is not used very efficiently in this prior art configuration.

According to the invention, the second circuit 2 controls the converter 4 to draw a second current signal $I_2$ from a fourth moment in time $T_4$ until a fifth moment in time $T_5$ during the period of the voltage signal $U_{in}$. These fourth and fifth moments in time $T_4$ and $T_5$ are, as shown in the lower graph of the FIG. 2, situated after the third moment in time $T_3$. As a result, energy that is still present in the first circuit 1 can be used, for example from the zero-crossing Z to the next firing angle F, and this is a great improvement of an energy efficiency of a combination of the apparatus 1, 2 and the converter 4.

At the third moment in time $T_3$, the converter 4 stops drawing the first current signal $I_1$. From the third moment in time $T_3$ until the fourth moment in time $T_4$, the voltage signal $U_{out}$ substantially keeps its value, owing to the fact that the output capacitors 32, 34, 35 are keeping their charges. From the fourth moment in time $T_4$ until the fifth moment in time $T_5$, the voltage signal $U_{out}$ drops to zero in a substantially linear way (in the exemplary case that the converter 4 is drawing a relatively constant current signal), owing to the fact that the output capacitors 32, 34, 35 are being discharged.

Figure 3:
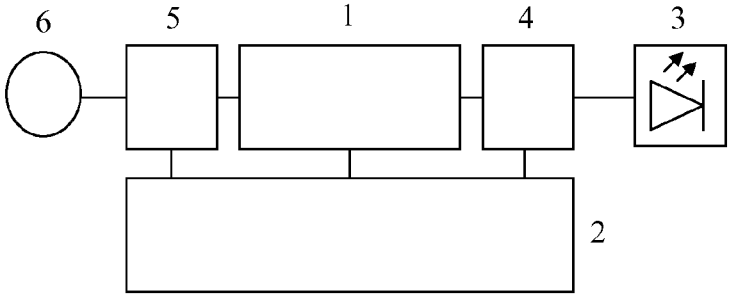
FIG. 3 shows an overview.

Preferably, for the first circuit 1 for example comprising one or more output capacitors 32, 34, 35, the first current signal $I_1$ may be drawn via the first circuit 1 and via the phase-cut dimmer 5 from a supply 6 shown in the FIG. 3, and the second current signal $I_2$ may be drawn from the one or more output capacitors 32, 34, 35 of the first circuit 1.

Preferably, the third moment in time $T_3$ may be an adaptable moment in time, whereby the converter 4 may thereto be arranged to adapt a next third moment in time in dependence of an amount of energy transferred via the second current signal $I_2$. In other words, a first amount of energy supplied via the phase-cut dimmer 5 may be reduced to compensate for a second amount of energy retrieved between the zero-crossing Z and the next firing angle F.

Preferably, the third moment in time $T_3$ may be an adaptable moment in time, whereby the second circuit 2 may thereto comprise the adaptor 61 for adapting a next third moment in time in dependence of an amount of energy transferred via the second current signal $I_2$. In other words, a first amount of energy supplied via the phase-cut dimmer 5 may be reduced to compensate for a second amount of energy retrieved from the zero-crossing Z to the next firing angle F. The adaptor 61 may thereto comprise a calculator and may thereto communicate with the storage medium 65. The storage medium 65 may store (definitions or representations of) the moments in time and (definitions or representations of) zero-crossings and (definitions or representations of) firing angles and (definitions or representations of) calculation results etc.

Usually, the first and second and third moments in time $T_1$ and $T_2$ and $T_3$ may be situated before the zero-crossing Z of the voltage signal $U_{in}$, and the fourth moment in time $T_4$ may be situated on or after the zero-crossing Z of the voltage signal $U_{in}$ and the fifth moment in time $T_5$ may be situated after the zero-crossing Z of the voltage signal $U_{in}$ and before a next first moment in time corresponding with a next firing angle F. Such a zero-crossing Z is relatively easy to estimate or to detect and forms a good point of reference. The second circuit 2 may thereto comprise a zero-crossing estimator 62 and/or 63 for estimating the zero-crossing Z and an activator 64 for in response to an estimation result from the estimator 62 and/or 63 activating the converter 4 to draw the second current signal $I_2$.

The amount of time between the first moment in time $T_1$ and the second moment in time $T_2$ is usually defined by properties of the first circuit 1 and/or by properties of the converter 4 and/or by the converter 4. The third moment in time $T_3$ is defined by the second circuit 2 and/or by the converter 4. The fourth moment in time $T_4$ is defined by the second circuit 2. The fifth moment in time $T_5$ is defined by the second circuit 2 or by the converter 4 or by the fact that all energy present in the output capacitors 32, 34 and/or 35 has been used.

In the FIG. 3, an overview is shown. A supply 6 such as a mains supply or such as a source is coupled to an input of a phase-cut dimmer 5. A load 3 for example comprising a light circuit is coupled to an output of a converter 4. A first circuit 1 interfaces the phase-cut dimmer 5 and the converter 4. A second circuit 2 controls the converter 4 in response to a communication with the first circuit 1 and/or with the phase-cut dimmer 5.

First and second elements can be coupled directly without a third element being in between or can be coupled indirectly via a third element. An estimation may comprise a relatively rough estimation or a relatively precise estimation or a detection. The contents of the first and second circuits 1 and 2 shown in the FIG. 1 are examples only.

Summarizing, apparatuses 1, 2 for driving loads 3 via converters 4 comprise first circuits 1 for interfacing phase-cut dimmers 5 and the converters 4. Firing angles of the phase-cut dimmers 5 correspond with first moments in time during periods of voltage signals presented to the phase-cut dimmers 5. The converters 4 draw first current signals from second until third moments in time during the periods. Second circuits 2 control the converters 4 to draw second current signals from fourth until fifth moments in time during the periods, to improve an energy efficiency. The first current signals may be delivered by supplies 6. The second current signals may be delivered by output capacitors 32, 34, 35 of the first circuits 1. The third moments in time may be adaptable. One or more of the first and second and third moments in time may be situated before a zero-crossing of the voltage signal and one or more of the fourth and fifth moments in time may be situated after the zero-crossing.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. An apparatus for driving a load via a converter, the apparatus comprising:

a first circuit for interfacing a phase-cut dimmer and the converter, a firing angle of the phase-cut dimmer corresponding with a first moment in time during a period of a voltage signal presented to the phase-cut dimmer, and the converter being arranged to draw a first current signal from a second moment in time until a third moment in time during the period of the voltage signal from the first circuit, the first circuit comprising a rectifier with first and second inputs arranged to be coupled to first and second outputs of the phase-cut dimmer and a filter coupled to the rectifier, the filter comprising one or more output capacitors, and a second circuit for controlling the converter to draw a second current signal from a fourth moment in time until a fifth moment in time during the period of the voltage signal from the first circuit, the fourth and fifth moments in time being situated after the third moment in time, wherein the first circuit further comprises:

a first diode with a first electrode coupled to a first output of the rectifier and with a second electrode coupled to the filter, and a bleeder with a main current path coupled to the first electrode of the first diode and to the second output of the rectifier and with a bias current path coupled to the second electrode of the first diode and to the second output of the rectifier.

2. The apparatus as defined in claim 1, the first current signal being drawn via the first circuit and via the phase-cut dimmer from a supply, and the second current signal being drawn from the one or more output capacitors of the first circuit.

3. The apparatus as defined in claim 1, the third moment in time being an adaptable moment in time, and the second circuit being arranged to adapt a next third moment in time in dependence of an amount of energy transferred via the second current signal.

4. The apparatus as defined in claim 1, the second circuit comprising an adaptor for adapting a next third moment in time in dependence of an amount of energy transferred via the second current signal.

5. The apparatus as defined in claim 1, the first and second and third moments in time being situated before a zero-crossing of the voltage signal, the fourth moment in time being situated on or after the zero-crossing of the voltage signal and the fifth moment in time being situated after the zero-crossing of the voltage signal and before a next first moment in time corresponding with a next firing angle.

6. The apparatus as defined in claim 5, the second circuit comprising a zero-crossing estimator for estimating the zero-crossing and an activator for in response to an estimation result from the zero-crossing estimator activating the converter.

7. The apparatus as defined in claim 1, the main current path of the bleeder comprising a serial connection of a first resistor and main electrodes of a transistor and a current source for defining a bleeder current signal, and the bias current path comprising a serial connection of a second resistor and a voltage defining element, a common point of the second resistor and the voltage defining element being coupled to a control electrode of the transistor via a second diode, the control electrode of the transistor being coupled to the second output of the rectifier via a biasing capacitor.

8. The apparatus as defined in claim 1, the first circuit not comprising a resistor coupled in parallel to the first diode, or the first circuit comprising a third resistor having a value larger than 100 kΩ coupled in parallel to the first diode.

9. The apparatus as defined in claim 1, the filter further comprising an inductor with a first terminal coupled to the second electrode of the first diode and with a second terminal arranged to be coupled to a first input of the converter, the second electrode of the first diode being coupled to the second output of the rectifier via a parallel connection of a first output capacitor and a serial connection of a fourth resistor and a second output capacitor, and the second terminal of the inductor being coupled to the second output of the rectifier via a third output capacitor, the second output of the rectifier being arranged to be coupled to a second input of the converter.

10. The apparatus as defined in claim 1, the first circuit further comprising:

a first series damper resistor arranged to be coupled to the first output of the phase-cut dimmer and to the first input of the rectifier, and/or a second series damper resistor arranged to be coupled to the second output of the phase-cut dimmer and to the second input of the rectifier, and/or a voltage dependent resistor arranged to be coupled to the first and second outputs of the rectifier.

11. A first device comprising the apparatus as defined in claim 1 and further comprising the converter and/or the load.

12. The device as defined in claim 11, the third moment in time being an adaptable moment in time, and the converter being arranged to adapt a next third moment in time in dependence of an amount of energy transferred via the second current signal.

13. A second device comprising the apparatus as defined in claim 1 and further comprising the phase-cut dimmer.

14. A method for driving a load via a phase-cut dimmer and via a converter, a firing angle of the phase-cut dimmer corresponding with a first moment in time during a period of a voltage signal presented to the phase-cut dimmer, and the converter being arranged to draw in a first step via a first circuit a first current signal from a second moment in time until a third moment in time during the period of the voltage signal, the method comprising a second step of controlling by a second circuit for the converter to draw via the first circuit a second current signal from a fourth moment in time until a fifth moment in time during the period of the voltage signal, the fourth and fifth moments in time being situated after the third moment in time, an additional step of extending a time-interval during which a bleeder current is withdrawn from the phase-cut dimmer by withdrawing the bleeder current by a bleeder, and providing a first diode such that a main current path of the bleeder is before the first diode.

15. A method for driving a load according claim 14, wherein said first circuit comprises one or more output capacitors, said second step of controlling by a second circuit for the converter to draw via the first circuit the second current signal is drawing the second current signal from said output capacitors, and said step of providing the first diode is for preventing that the one or more output capacitors are discharged by the main current path of the bleeder.

* * * * *